US008505622B1

(12) United States Patent
Harris et al.

(10) Patent No.: US 8,505,622 B1
(45) Date of Patent: Aug. 13, 2013

(54) CONICAL DEFLECTION WEDGE SYSTEM FOR OIL AND GAS WELLS AND THE METHOD OF USE THEREOF

(76) Inventors: Robert Harris, Anchorage, AK (US); Carl Diller, Anchorage, AK (US); Candice English, Anchorage, AK (US)

( * ) Notice: Subject to any disclaimer, the term of this patent is extended or adjusted under 35 U.S.C. 154(b) by 319 days.

(21) Appl. No.: 12/807,607

(22) Filed: Sep. 9, 2010

(51) Int. Cl.
*E21B 7/06* (2006.01)

(52) U.S. Cl.
USPC ..... 166/117.5; 175/78

(58) Field of Classification Search
USPC ..... 166/117.5, 117.6; 175/61, 78
See application file for complete search history.

(56) References Cited

U.S. PATENT DOCUMENTS 4,084,639 A * 4/1978 Todd ..... 166/248
5,725,060 A * 3/1998 Blount et al. ..... 175/61
6,206,111 B1 3/2001 Nistor
6,279,659 B1 * 8/2001 Brunet ..... 166/313
RE39,141 E 6/2006 Gondouin
RE40,067 E 2/2008 Gondouin

* cited by examiner

*Primary Examiner* — David Bagnell
*Assistant Examiner* — Taras P Bemko
(74) *Attorney, Agent, or Firm* — Michael J. Tavella

(57) ABSTRACT

A tool and method for drilling a secondary hole (window) from a pre-determined position within a well bore into the adjacent rock or formation. The invention includes an internal (relative to the production tubing) primary deflection wedge transitioning into an externally attached (relative to the production tubing) conical device that aids in the exit from the production tubing through the production casing, where a significant standoff exists between the smaller production tubing (completion) and the larger ID production casing. The primary deflection wedge serves as a directional guide to exit the production tubing. The conical device provides a way to transition and support a milling device to exit the adjacent casing at a desired angle without having the milling device move off the preferred course. This two-part assembly is called a tandem wedge kick off assembly.

12 Claims, 10 Drawing Sheets

CONICAL DEFLECTION WEDGE SYSTEM FOR OIL AND GAS WELLS AND THE METHOD OF USE THEREOF

CROSS REFERENCE TO RELATED APPLICATIONS

Not Applicable

STATEMENT REGARDING FEDERALLY SPONSORED RESEARCH AND DEVELOPMENT

Not Applicable

BACKGROUND OF THE INVENTION

1. Field of the Invention

This invention relates to deflection wedges for oil and gas wells and particularly to deflection wedges having a conical body.

2. Description of the Prior Art

Deflection wedges have been used in drilling oil wells for many years. These wedges serve as a directional guide to exit the production tubing when drilling a secondary hole (window) from a predetermined position within a well bore into the adjacent rock or formation. Traditionally, these wedges have been limited devices that tend to guide the production tubing in a narrow range. Examples of such systems are found in the Following U.S. Pat. Nos. RE40067, RE39141, and 6,206,111, as well as numerous other patents.

The current slim hole rotary (SHR) and coil tubing drilling (CTD) industry is restricted to window exits based on current completion designs. For example, many wells in the industry have 7" casing with 4½" completion tubing. These wells can be serviced by SHR and CTD with mechanical means of setting a device that is run through the completion tubing and set in the larger ID production casing.

New and re-completed wells with smaller completion tubing (<3½") that maintain larger production casing (non "mono-bore" completions, <7", 7⅝" and 9⅝") present a unique challenge as they are typically not designed for a mechanical means of a casing exit. Currently these type wells incorporate the use of cement "plug back" to mill ramp up to the larger ID casing, after which they time drill an exit. In some cases a pilot hole through the cement is drilled and a whip stock is set in the pilot hole for a mechanical exit in the casing.

One problem that these types of operations have is that, when using narrow wedges, the tubing can veer away from the desired line. When this happens, the production tubing often actually runs downward, parallel to the existing well casing, instead of moving off at the desired angle.

BRIEF DESCRIPTION OF THE INVENTION

The present invention provides a means and method for drilling a secondary hole (window) from a pre-determined position within a well bore into the adjacent rock or formation. The invention includes an internal (relative to the production tubing) primary deflection wedge transitioning into an externally attached (relative to the production tubing) conical device that aids in the exit from the production tubing through the production casing, where a significant standoff exists between the smaller production tubing (completion) and the larger ID production casing.

The primary deflection wedge serves as a directional guide to exit the production tubing; the conical device provides a means to transition and support a milling device to exit the adjacent casing.

To aid in the transition and support (axial and helical) of the exit, cement is in introduced into the void between the production tubing and the housing of the conical device. This two-part assembly is called a "tandem wedge kick off assembly" (TWKOA).

The tandem wedge kick off assembly can be incorporated in any new or re-completed well. It is strategically placed in the completion tubing at a pre-determined depth and allowed to remain during normal production.

The TWKOA provides the foundation to mill a casing exit without having to abandon the original well bore, which necessitates, pumping cement for a plug. The TWKOA allows an operator to maintain production from the original well bore, if desired. This is because the internal mechanisms of the TWKOA allow production and intervention until such time the assembly is to be used to create a new well bore (window exit).

After the completion of a new lateral well bore, an internal kick off wedge device can be removed from the assembly and access to the original well bore retained.

The TWKOA comprises of several different components. First, is the completion tubing used in the TWKOA. This tubing maintains the same OD & ID and physical properties (or greater) as the completion tubing. Next is a locator sub unit, for which are two designs—one accommodates an internal wedge that can be used to start the side track in the production tubing with a 9 degree increment orientation capability spline. The second design has a locating profile that can be used to pinpoint depth and set any style of wedge and anchor by aligning the bottom of the scoop above the secondary wedge/cone, which maintains the direction for the full side track. Next is a bottom sub, which can be a wire line entry guide (WLEG), or more completion tubing. Next is a top sub of the outer housing, which is used to fill the housing with cement. Next is a bottom sub of the housing; this sub has a tight fit over the inner tubing body and a taper (wedge/cone) that acts as a secondary ramp providing a continuous path to the casing for the side track assembly. There is a housing assembly, which is a thin wall pipe that covers the secondary wedge/cone and is filled with cement. The cement here is used to help stabilize the sidetrack assembly as it travels up the secondary ramp and when contacting the outer casing. In addition, there is an orienting snap-in anchor assembly, which holds the internal wedge in place and at the predetermined orientation. It has an external spline that mated to an internal spline (this allows the internal wedge to be oriented in 9 degree increments) and also prevents torque from moving the wedge. In another embodiment, gears can be used that can provide orientation in one-degree increments. Finally, there is an internal wedge, or deflection device, that is placed in the production tubing that diverts the side track assembly in the desired direction for drilling. (This is attached to the snap-in anchor). The internal wedge also can be fitted to a retrievable or permanent anchor and be used with the first design of the locator sub unit with a proper space to still use the outer wedge, if damage to spline assembly does not allow proper set position of the snap in anchor.

The used of this device provides a financial benefit because the user does not have to use cement, which is a costly component. The user also saves the rig time involved in the drilling of a pilot hole while still having to insert a mechanical means of making a casing exit. Finally, the user saves the production from the main bore of the well after the side track, which further adds to the economic value of this equipment.

DETAILED DESCRIPTION OF THE INVENTION

Figure 1:
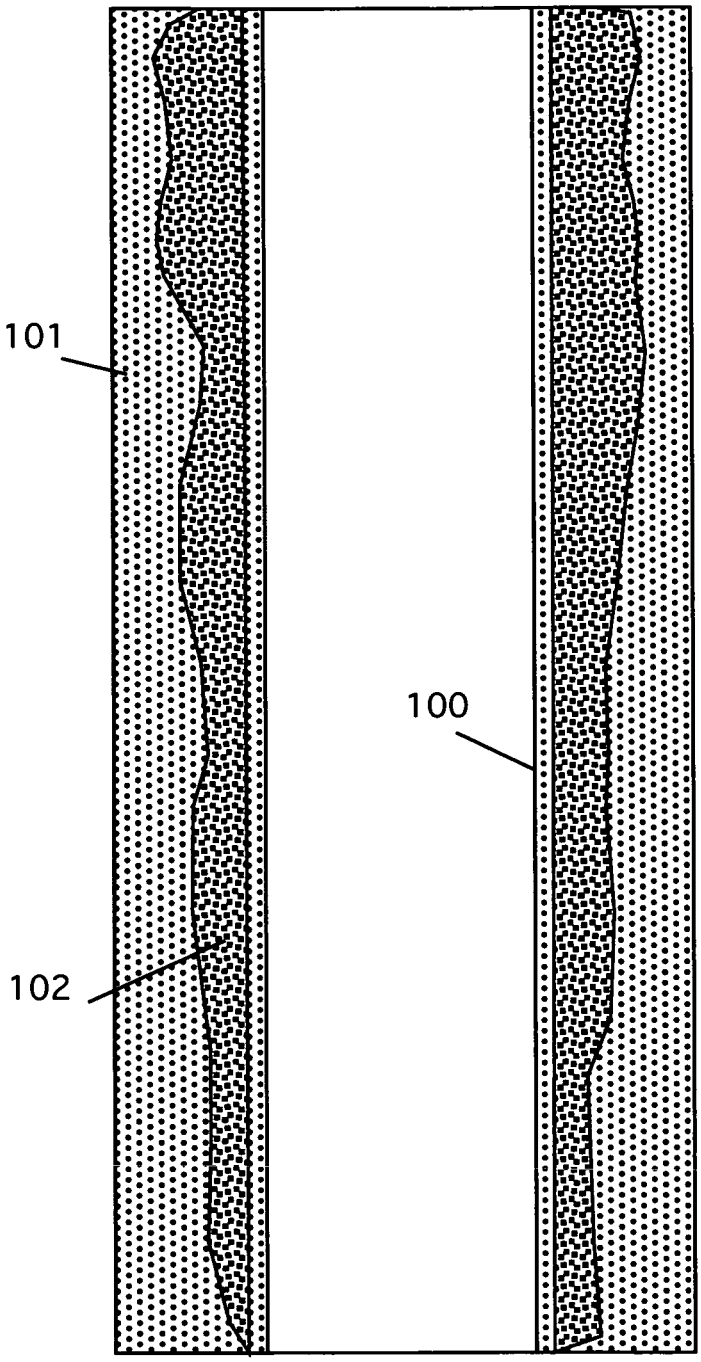
FIG. 1 is a cross-sectional view a well bore prior to production tubing and completion being run.

Referring now to FIG. 1, a casing 100 that is cemented in well bore 101 prior to production tubing and completion being run is shown. The cement 102 surrounds the casing to hold it in place.

Figure 2:
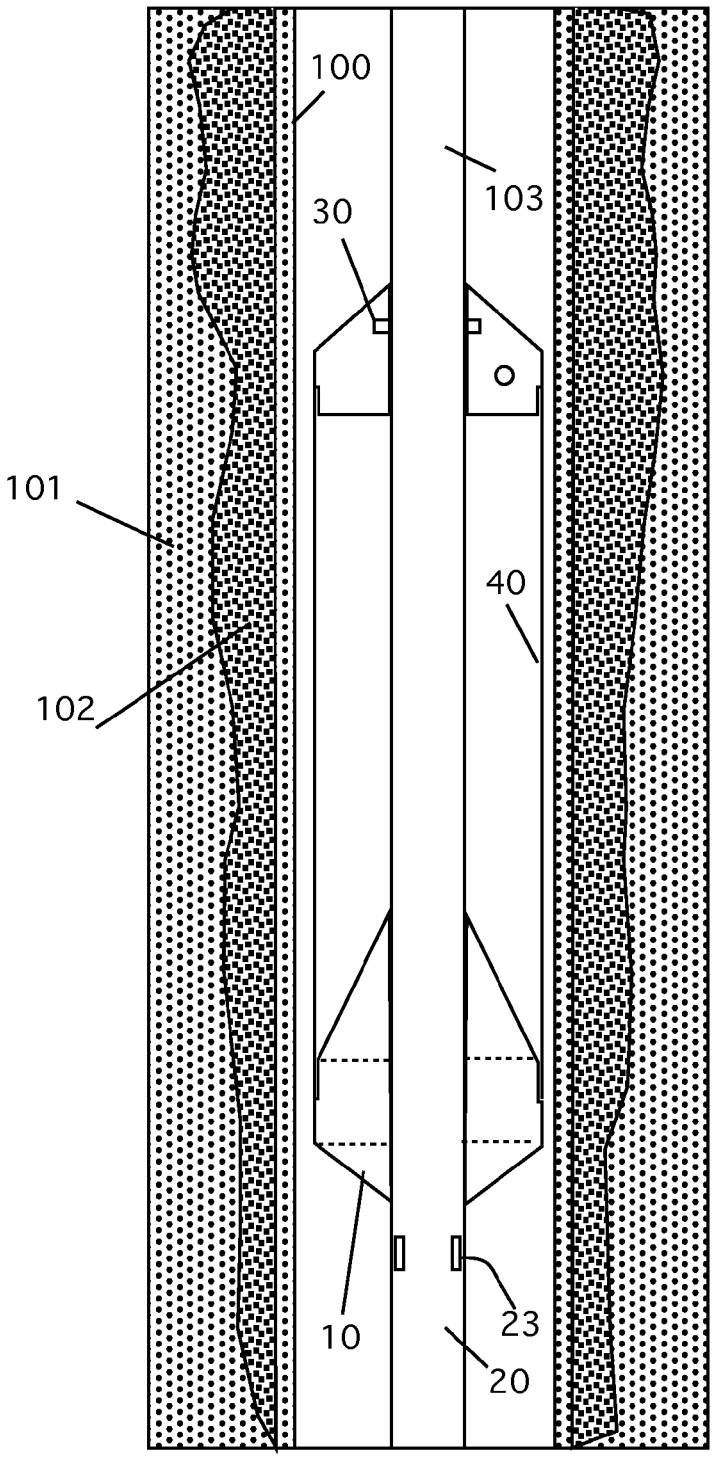
FIG. 2 is a detail view the well bore where the production tubing has been run, and showing the cone housing, which is integral to the tubing.

FIG. 2 shows the well bore and casing after the production tubing 103 has been run. In this view, key elements of the tandem wedge kick off assembly have been installed. These components are placed at the time of the initial well completion. They include a cone housing 40 that contains a conical secondary exit wedge 10 (see FIG. 11), which is integrally attached to the tubing as part of the completion assembly. The cone housing 40 has an open channel 40*a* and the conical secondary exit wedge has an open channel 11 though its center to permit the free flow of oil or gas through it for normal well production. Note that the conical secondary exit wedge 10 is placed at the pre-determined "exit" point relative to the production tubing and production casing. Also installed at this time is a bottom sub 20 with a deflection wedge locator 23 (see FIG. 9); a top sub 30 for the cone housing 40.

Once this unit is installed, the well can be operated for as long as desired. When the operator wants to open a window, additional components are added as discussed below.

Figure 3:
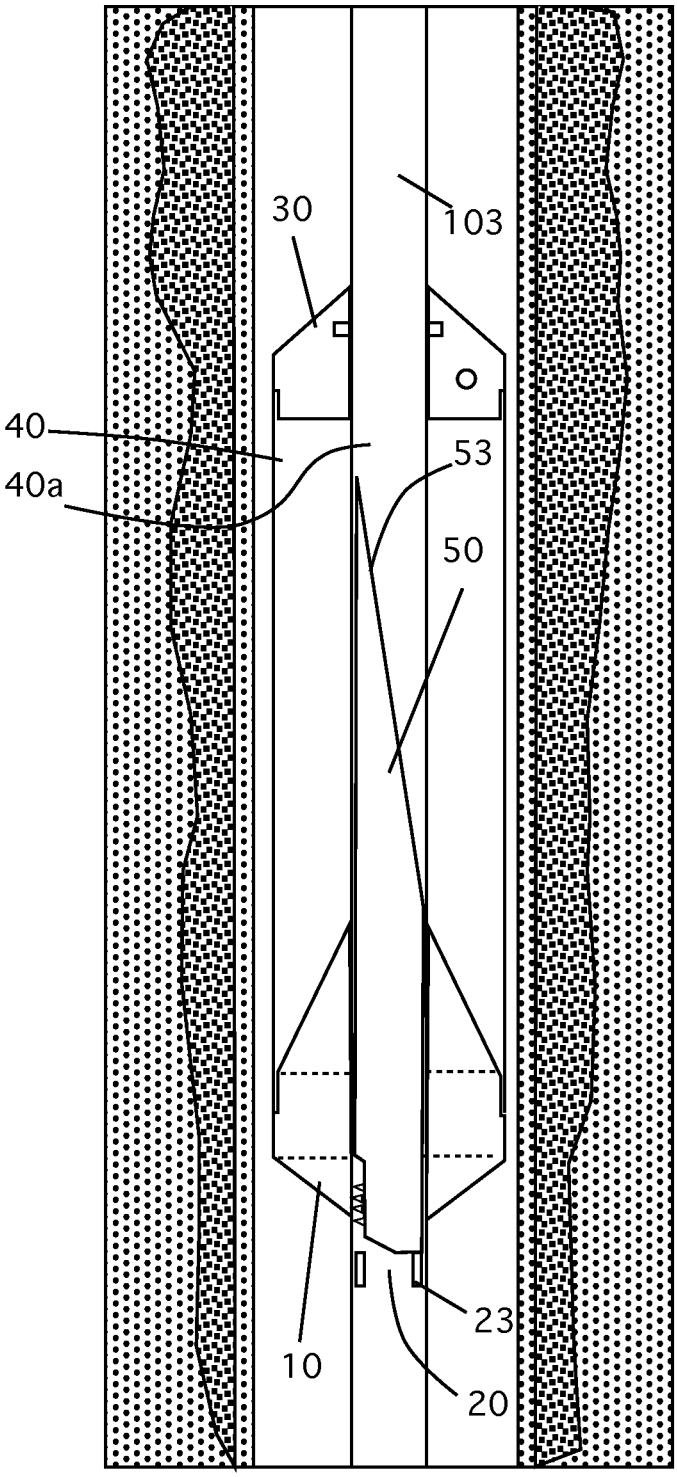
FIG. 3 a detail view the well bore showing the primary internal exit wedge has been placed in respective location after engaging the wedge locator.
Figure 9:
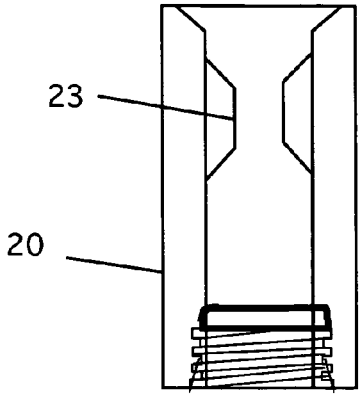
FIG. 9 is a detail view of the bottom sub with locator profile.

FIG. 3 shows a primary internal exit wedge 50 that has been placed in its respective location after engaging the primary internal exit wedge locator 23 in the bottom sub 20 (see FIG. 9). The direction angle or "tray face" 53 of the primary internal exit wedge 50 can be set anywhere in 1 degree increments for 360 degrees, as discussed below.

Figure 4:
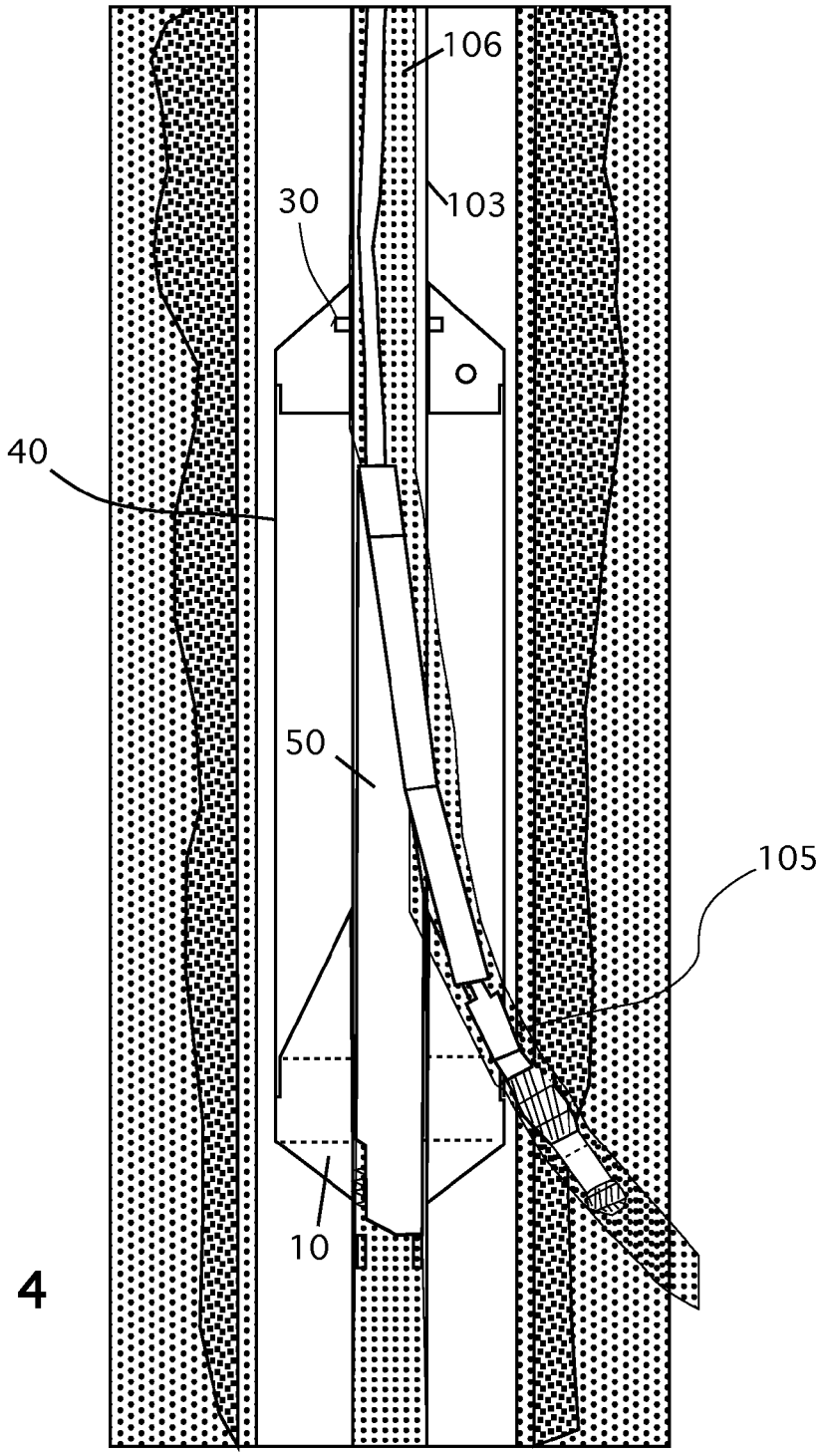
FIG. 4 is a detail view of the well bore showing the entire assembly including the directional path the milling device follows to exit the production tubing, the housing using the cone housing as the secondary deflection and support apparatus, and the adjacent production casing.

FIG. 4 shows the full assembly including the directional path the milling device 105 follows to exit the production tubing 103, the cone housing 40 using the secondary exit wedge 10 as the secondary deflection and support apparatus, and the adjacent production casing 100. Also shown is an additional quantity of drilling mud 106 that is used to aid in the drilling. Note that the primary internal exit wedge 50 initially steers the milling device toward the side casing and the secondary exit wedge 10 ensures that the milling device stays on the desired path.

Figure 5:
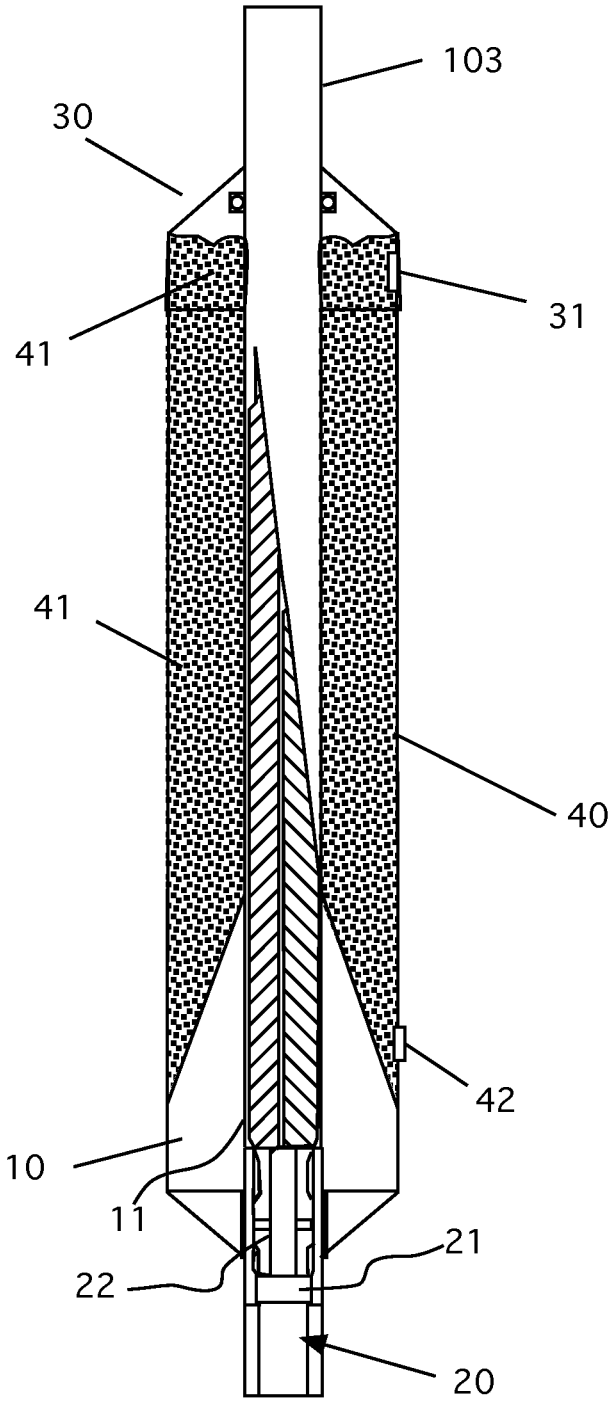
FIG. 5 is a diagrammatic view of the tandem wedge kick off assembly.

FIG. 5 is a diagrammatic view of the tandem wedge kick off assembly, showing the major components as discussed above. The production tubing 103 is shown extending upward of the top sub 30. It attaches to the regular tubing used in the well completion. The top sub 30 is shown installed. A cement filling port 31 is shown on the side of the top sub (see also FIG. 6). This port is used to fill the outer shell of the cone housing 40 with cement 41. Note that there is a vent port 42 at the bottom of the cone housing. This allows air to escape the cone housing when the cement is being poured. At the bottom of the cone housing is the secondary exit wedge 10. Note that, as discussed above, the secondary exit wedge 10 has an open center 11 of the same I.D. as the production tubing (see also FIG. 11). This allows full flow to pass through the TWKOA during normal well operations. Below the secondary exit wedge 10 is the bottom sub 20. Within the bottom sub 20 is a latch housing 21. Within the latch housing is a latch assembly 23. The latch assembly is used to secure the primary internal exit wedge 50 that has been placed in respective location after engaging latch assembly.

Figure 6:
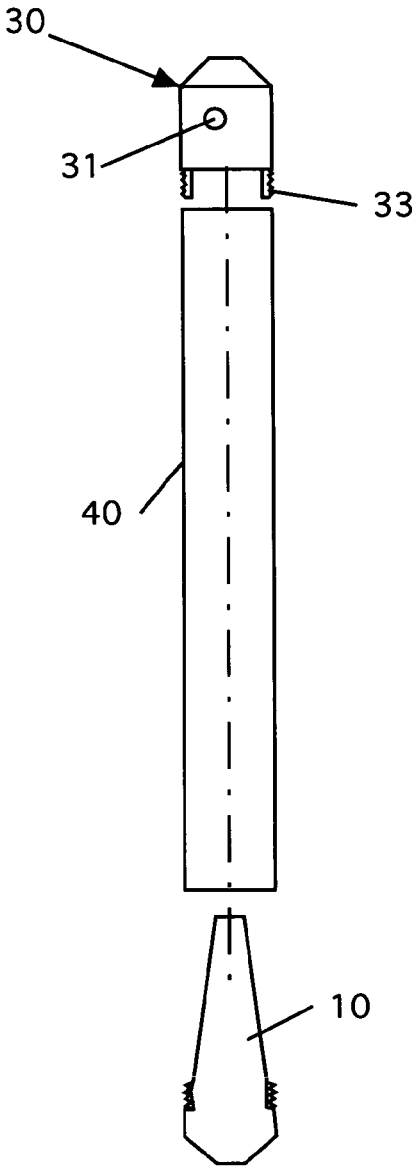
FIG. 6 is an exploded view of the top sub, cone housing and secondary exit wedge assembly.

FIG. 6 is an exploded view of the top sub 30, cone housing 40 and secondary exit wedge 10. In this view, the cement fill port 31 in the top sub is shown from the front view. Note that the top sub 30 has threads 33 that engage threads in the cone housing 40. Note also that the secondary exit wedge 10 is also threaded (see FIG. 11).

Figure 7:
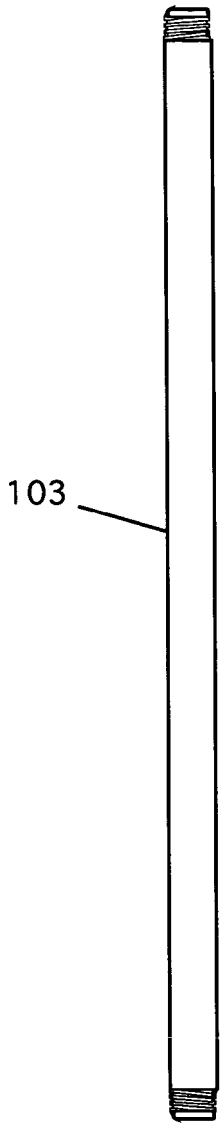
FIG. 7 is a detail side view of a length of completion tubing.

FIG. 7 is a detail side view of a length of completion tubing 103. This tubing is made in specific lengths and is assembled as the well is being completed.

Figure 8:
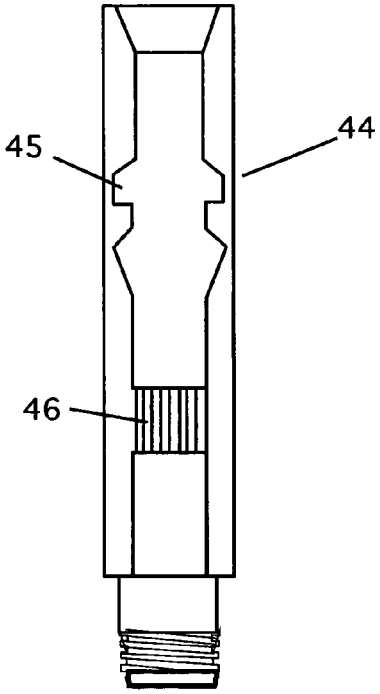
FIG. 8 is a detail view of the locator sub unit.

FIG. 8 is a detail view of the locator sub collet assembly unit 44. This unit is used to orient the primary internal exit wedge 50 properly and then, in conjunction with the snap-in anchor assembly 70 (see FIG. 12) is used to lock the assembly in place. The locator sub collet assembly unit 44 has a set of ears 45 that snap into matching ears 72 on the snap-in anchor assembly 70. In the preferred embodiment, both the snap-in anchor assembly 70 and the locator sub collet assembly unit 44 have 360-degree gears installed. In the case of the locator sub collet assembly unit 44, the gear is 46. This gear aligns with the matching gear 73 in the snap-in anchor assembly 70. The locator sub collet assembly unit 44 is then turned until the proper position is reached and the gears are meshed and locked. Note that both of these types of units are readily used in the oil drilling industry and are well known in the art.

FIG. 9 is a detail view of the bottom sub 20 with locator profile 23. The locator profile is used to set the position of the primary internal exit wedge 50, by marking the lowest position the primary internal exit wedge 50 can be positioned. As shown in FIG. 3, for example, the bottom of the primary internal exit wedge 50 shown atop the locator profile 23, which acts as a stop for the primary internal exit wedge 50.

Figure 10:
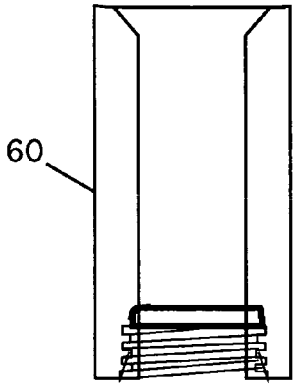
FIG. 10 is a detail view of the wire line entry guide.

FIG. 10 is a detail view of the wire line entry guide 60. This tool is used for well installation work involving a wire line.

Figure 11:
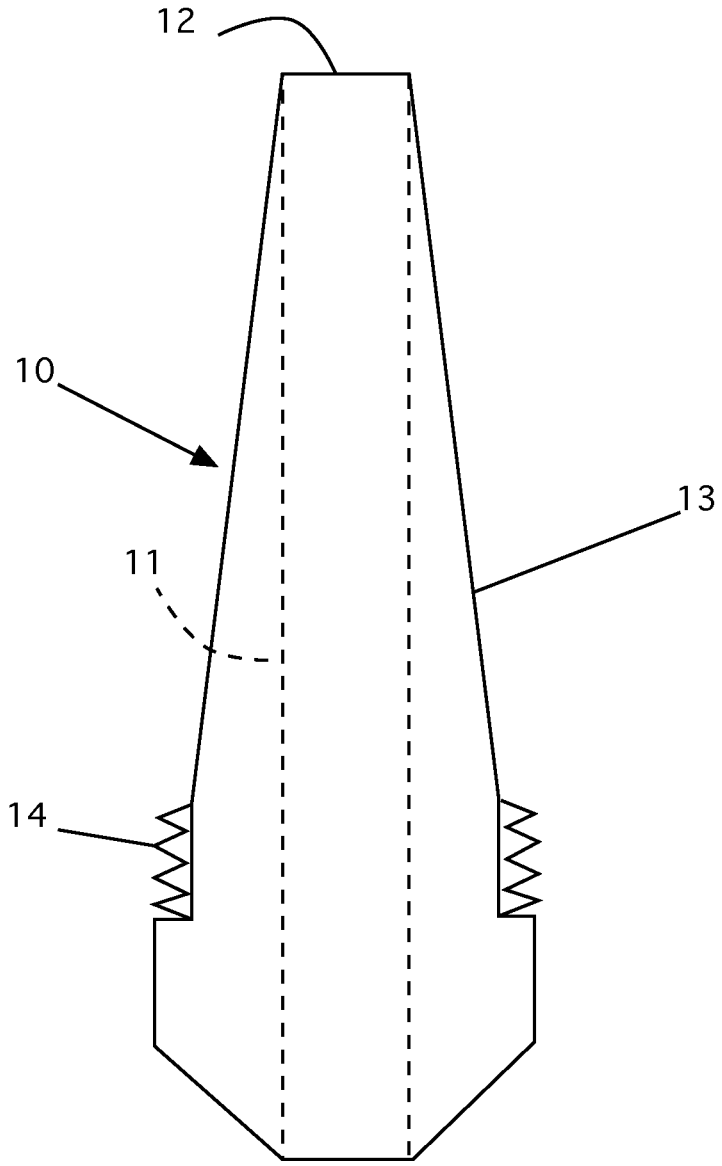
FIG. 11 is an enlarged side view of the secondary exit wedge

FIG. 11 is an enlarged side view of the secondary exit wedge 10. The secondary exit wedge has an open center 11 that conforms to the I.D. of the production pipe in use in the well. The secondary exit wedge has a flat top 12 and sloping sides 13. The sloped sides end at the threaded portion 14. Below the threads, the secondary exit wedge extends downward vertically for a small distance before angling back in to the center as shown.

Figure 12:
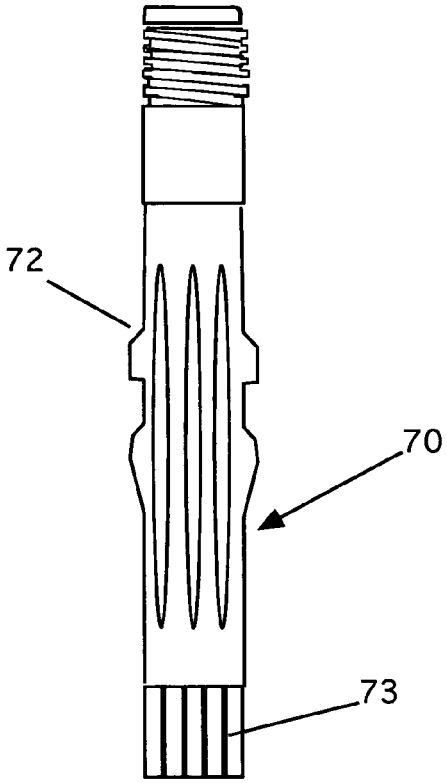
FIG. 12 is a side detail view of the snap-in anchor assembly with orientation spline.

FIG. 12 is a side detail view of the snap-in anchor assembly 70 with orientation spline 71. As discussed above this assembly also has ears 72 and a gear 73 that mesh with the ears and gear on the locator sub collet assembly unit 44.

Figure 13:
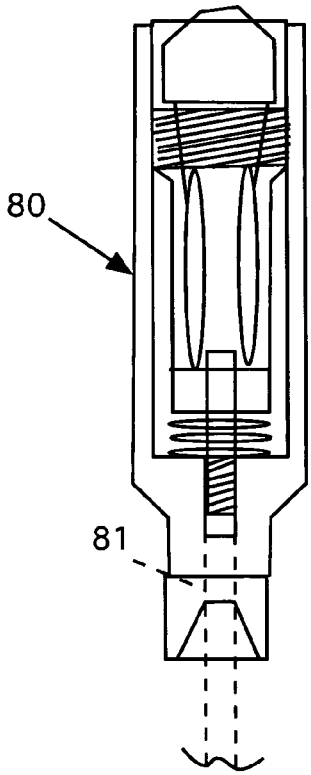
FIG. 13 is a detail view of the primary internal exit wedge-retrieving tool.

FIG. 13 is a detail view of the primary internal exit wedge-retrieving tool 80. This tool is used to remove the primary internal exit wedge 50 after the window has been completed. It does this as follows. At the bottom of the primary internal exit wedge-retrieving tool 80 is a shaft 81 that extends downward through the primary internal exit wedge and into the primary internal exit wedge-setting tool 90, where it is screwed into the receiver 91. With the three units connected, the retrieving tool removes the entire assembly when the drilling and milling operations is complete.

Figure 14:
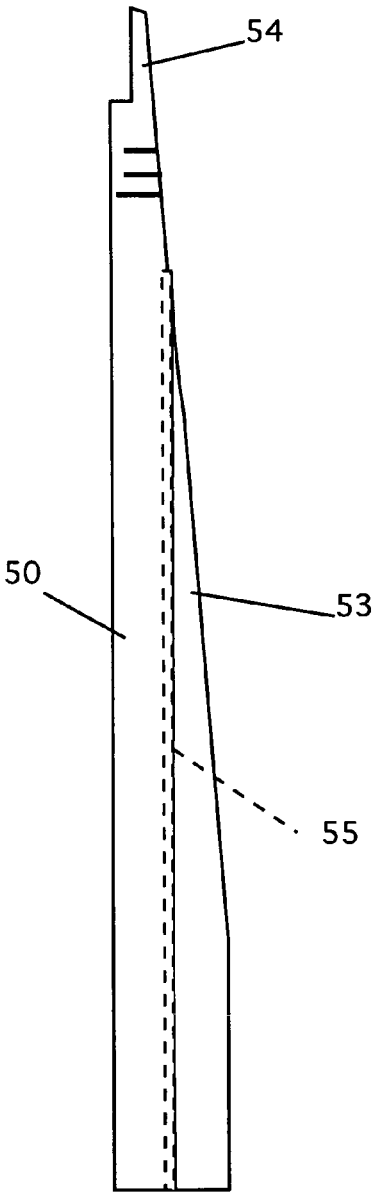
FIG. 14 is a side detail view of the primary internal exit wedge, or deflection device.

FIG. 14 is a side detail view of the primary internal exit wedge 50. As noted above, this device is used to create the initial angle for the milling element to angle off to cut the window. The primary internal exit wedge 50, as noted above, also has a cylindrical opening 55 through it that allows the shaft 81 of the primary internal exit wedge-retrieving tool 80 to pass through it so that it can connect to the primary internal exit wedge-setting tool 90. In this way the primary internal exit wedge-retrieving tool, the primary internal exit wedge and the primary internal exit wedge-retrieving tool are connected together so that they are set in place as one unit and later removed as one unit.

Figure 15:
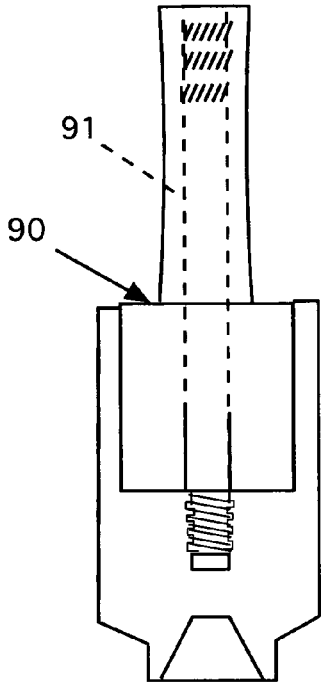
FIG. 15 is a side detail view of the primary internal exit wedge-setting tool.

FIG. 15 is a side detail view of the primary internal exit wedge-setting tool 90. This tool is used to position the primary internal exit wedge 50 in the production tubing and to adjust its position to the desired angle to form the window, as discussed above.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

We claim:

1. A conical deflection wedge system, installed as part of a section of production tubing in a well bore comprising:

a) a bottom sub;

b) a cone housing having a continuous outer surface, attached to the bottom sub and extending upward therefrom, said cone housing having an open center such that throughput from said well bore can flow therethrough;

c) a conical secondary exit wedge, having an open center portion, installed completely within the continuous surface of said cone housing, such that throughput from said well bore can flow therethrough; and d) a top sub, attached to said cone housing and extending upwardly therefrom.

2. The conical deflection wedge system of claim 1 wherein the top sub has a cement fill port formed therein.

3. The conical deflection wedge system of claim 2 wherein the cone housing has a hollow exterior shell and an interior wall, and further wherein the hollow exterior shell is filled with cement.

4. The conical deflection wedge system of claim 1, where in the bottom sub further includes a locator profile for stopping a primary internal exit wedge, inserted into said cone housing, at a desired position within said cone housing.

5. The conical deflection wedge system of claim 1 wherein the conical secondary exit wedge has a flat top and sloping sides.

6. The conical deflection wedge system of claim 5 wherein the conical secondary exit wedge further comprises a threaded portion.

7. A method of installing a system for opening a window on a production well having a side casing comprising the steps of:

a) installing a first quantity of production tubing, having a top end, into said production well casing;

b) attaching a bottom sub, having a top end, to the top end of said first quantity of production tubing;

c) attaching a cone housing having a continuous outer surface, and having an open center to the top end of said bottom sub, said cone housing having a top, and includes a conical secondary exit wedge also having an open center, installed completely within the continuous surface of said cone housing;

d) attaching a top sub to the top of said cone housing; e) attaching a second quantity of production tubing to said top sub; f) inserting the bottom sub, cone housing and top sub into said production well casing; and g) attaching said second quantity of production tubing to said top sub and inserting said second quantity of production tubing into said well casing until the cone housing is at a desired depth.

8. The method of claim 7 further comprising the steps of:

a) completing said production well; and b) producing a quantity of oil through said production well.

9. The method of claim 7 further comprising the steps of:

a) installing a primary internal exit wedge, having a tray face into said cone housing above said conical secondary exit wedge;

b) installing a milling device into said production tubing such that said milling device contacts said primary internal exit wedge and veers off to one side of said production tubing as said milling device descends into said well; and c) having said milling device contact said conical secondary exit wedge as said milling device continues to descend, thereby diverting said milling device at a greater angle from the vertical until said milling device penetrates said well casing and proceeds into an underground formation.

10. The method of claim 9 further comprising the step of: after step "a", seating said primary internal exit wedge in a locator profile installed in said bottom sub.

11. The method of claim 9 further comprising the step of adjusting the tray face at a desired operating angle prior to step "b" of claim 9.

12. The method of claim 9 further comprising the steps of: after step "c", a) removing the milling device from said production tubing;

b) removing said primary internal exit wedge from said production tubing; and c) completing the well for production.

* * * * *